US005333418A

United States Patent [19]

Chambers

[11] Patent Number: 5,333,418

[45] Date of Patent: Aug. 2, 1994

[54] RECESSED SMOKE DETECTOR

[76] Inventor: Ronald Chambers, 298 Division St., Tuckerton, N.J. 08087

[21] Appl. No.: 939,134

[22] Filed: Sep. 2, 1992

[51] Int. Cl.[5] ..... G12B 9/00; G08B 17/10

[52] U.S. Cl. ..... 52/39; 52/27; 248/906

[58] Field of Search ..... 52/27, 39; 248/906, 248/27.3, 205.1, 231.2, 343

[56] References Cited

U.S. PATENT DOCUMENTS

| | | | |
|---|---|---|---|
| 1,819,516 | 8/1931 | Kelly | 52/39 |
| 2,954,959 | 10/1960 | Kaufman et al. | 248/343 |
| 3,676,570 | 7/1972 | Gabb | 248/343 |
| 3,892,930 | 7/1975 | Wieder . | |
| 3,994,603 | 11/1976 | Paschedag . | |
| 4,090,178 | 5/1978 | Norris . | |
| 4,114,326 | 9/1978 | Macuga et al. . | |
| 4,126,971 | 11/1978 | Macuga et al. . | |
| 4,150,373 | 4/1979 | Ried, Jr. . | |
| 4,383,253 | 5/1983 | Lam et al. . | |
| 4,529,976 | 7/1985 | Jameson et al. . | |
| 4,702,452 | 10/1987 | Penar . | |
| 4,887,073 | 12/1989 | Nakao et al. . | |

*Primary Examiner*—Carl D. Friedman
*Assistant Examiner*—Kevin D. Wilkens
*Attorney, Agent, or Firm*—Mathews, Woodbridge & Collins

[57] ABSTRACT

An apparatus for installing a recessed smoke detector within a surface so that when installed, the smoke detector is substantially completely hidden from view and flush with said surface. Two mounting plates are attached to opposite sides of a housing. A pair of mounting clips attached to a cover are insertable, respectively, into slots in each of the mounting plates. The smoke detector is attached to the cover. The cover has the appearance of a loudspeaker-like grille or other similar device so that smoke can enter through apertures to reach the smoke detector. The cover after mounting is substantially flush with a surface, such as a ceiling. With the smoke detector substantially completely recessed within a surface and the cover connected to the housing, the smoke detector is substantially completely concealed, and protected from vandals and tamperers. The apparatus is easily installed, which is an important advantage with the increased need for smoke detector installation. The apparatus also provides an aesthetically pleasing surface appearance.

4 Claims, 3 Drawing Sheets

RECESSED SMOKE DETECTOR

BACKGROUND OF THE INVENTION

1. Field of the Invention

This invention relates to an apparatus for installing a smoke detector recessed into a ceiling so that when installed, the smoke detector is substantially completely hidden from view.

2. Description of Prior Art

Devices for installing smoke detectors are known in the art. For example, U.S. Pat. Nos. 4,114,326 and 4,126,971 (a continuation-in-part of U.S. Pat. No. 4,114,326) disclose a device for supporting smoke detectors from a fixture mounted inside a drop ceiling. U.S. Pat. No. 4,887,073 discloses a smoke detector mounted inside a fixture. The smoke detector protrudes somewhat below the ceiling. See also U.S. Pat. No. 4,150,373.

Devices for disguising a smoke detector are disclosed in U.S. Pat. Nos. 4,529,976 and 3,892,930.

Other devices for incorporating a smoke detector into fixtures in conjunction with other purposes are disclosed in U.S. Pat. Nos. 4,090,178 and 4,702,452.

U.S. Pat. Nos. 3,994,603 and 4,383,253 are cited as being of possible relevance only.

SUMMARY OF THE INVENTION

Briefly described, the invention comprises an apparatus for installing a recessed smoke detector in a ceiling so that when installed, the smoke detector is substantially completely hidden from view. The smoke detector is recessed and attached to a cover and contained within a housing or junction box commonly used by electricians when installing wiring. The housing or two-gang box is installed in a ceiling in the customary manner. The housing is of sufficient size to accommodate a smoke detector.

Mounting plates are attached to the housing through two apertures into which screws are inserted. The mounting plates have rectangular slots for receiving the mounting clips.

Mounting clips are attached to the cover. When the ends of the mounting clips are squeezed together and inserted into the rectangular slots of the mounting plates, and then released, the clips spring back to their original shape to hold the cover in place. The mounting clips have hooked ends to prevent the cover from separating from the housing.

The smoke detector is attached to the cover. The cover is intended to substantially completely conceal the smoke detector. The cover is substantially flush with a surface such as a ceiling. A loudspeaker grille or any other similar device is suitable as a cover. A plurality of apertures pass through the cover so that smoke can enter through the apertures to reach the smoke detector. A larger aperture passes through the cover to receive and allow the test light of the smoke detector to be visible.

The cover is easily connected to the housing, and substantially completely hides the smoke detector from view. When installed, the smoke detector is protected from vandalism and is substantially tamper-proof. Because the smoke detector is recessed, and the cover substantially flush with the surface, the appearance of the ceiling is aesthetically pleasing.

The invention may be more fully understood by reference to the following drawings.

DETAILED DESCRIPTION OF THE PREFERRED EMBODIMENT

During the course of this description like numbers will be used to identify like elements according to the different views which illustrate the invention.

Figure 1:
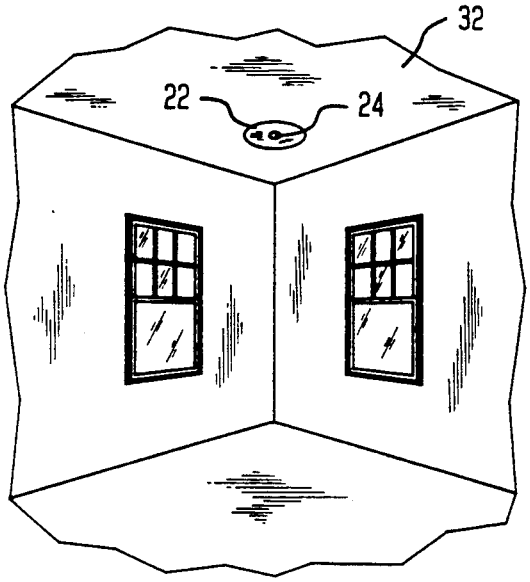
FIG. 1 is a view of the invention in the context of a room, showing the cover with a smoke detector installed behind it in a ceiling surface.

A cover 22 with a smoke detector 12 attached is installed within the surface of a ceiling 32 is illustrated in FIG. 1. Cover 22 is substantially flush with the surface of the ceiling 32.

Figure 2:
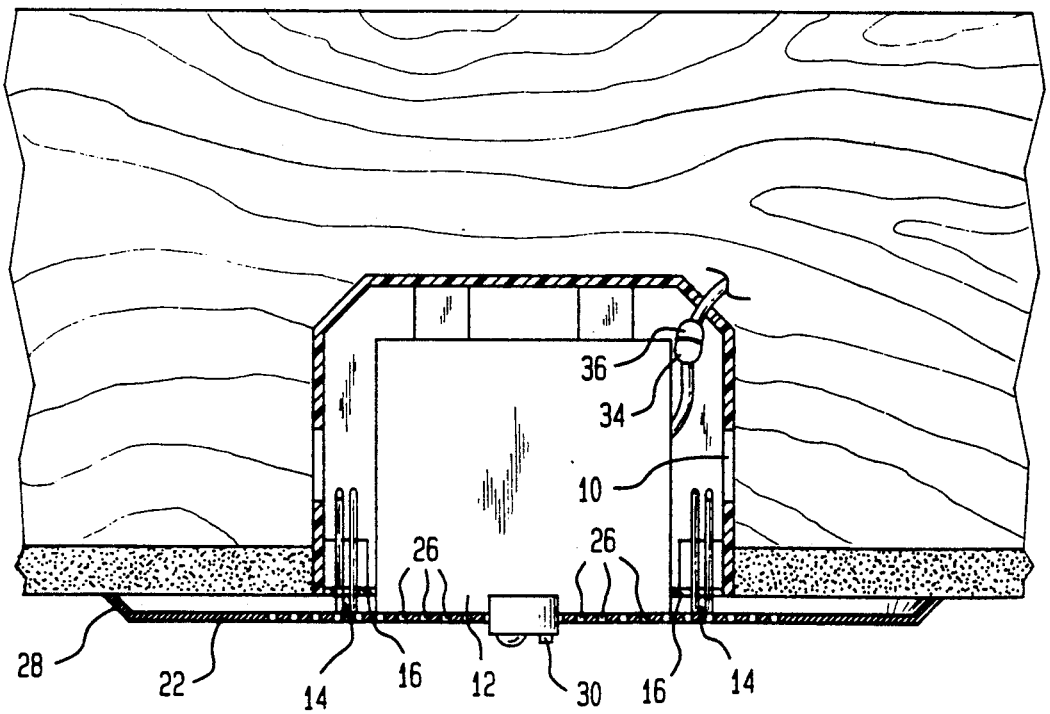
FIG. 2 is a cross-sectional, elevational view of the smoke detector attached to the cover and connected to the housing.

A cross-sectional, elevational view of the cover 22 connected to the housing 10 is illustrated in FIG. 2. A pair of mounting clips 14 are attached to the opposite sides of cover 22. A smoke detector 12 is shown attached to the cover 22 and installed within the housing 10. The test light 30 of the smoke detector 12 passes through large aperture 24.

Figure 3A:
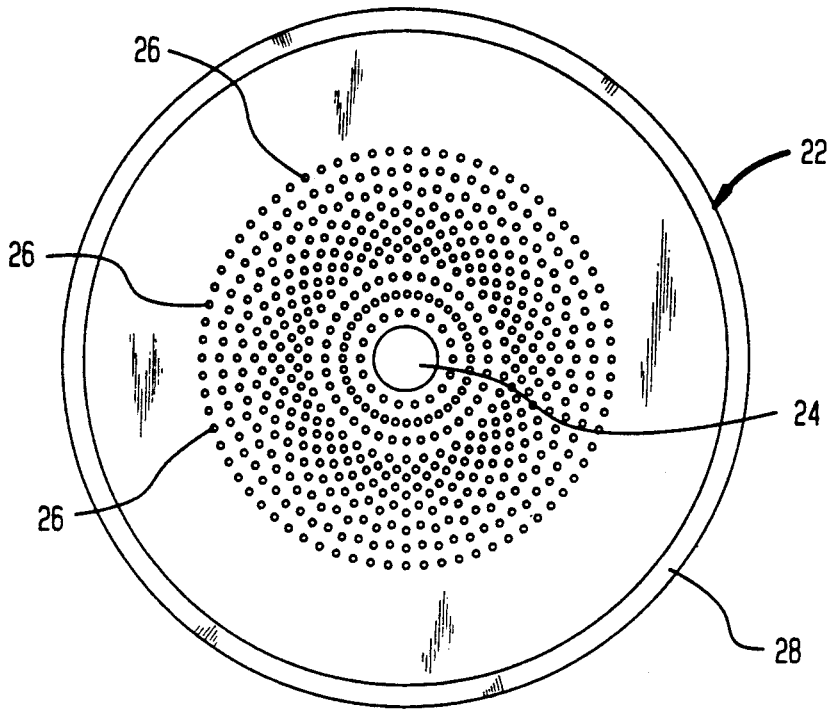
FIG. 3A is a perspective view of the cover as seen from the front side.

A perspective view of the cover 22 is illustrated in FIG. 3A. A large aperture 24 in cover 22 receives the test light 30 of the smoke detector 12 so that the test light 30 is visible when the cover 22 is connected to the housing 10. Smoke can reach the detector 12 through the plurality of apertures 26 in the cover 22. Two mounting clips 14 are attached to the cover 22 by wire or other suitable attachment means. The mounting clip 14 is made of a material, such as spring wire, so that when the ends are squeezed together, and then released, the clip 14 returns to its original shape. When the cover 22, shown with an annular rim 28, is connected to the housing 10 it is substantially flush with the ceiling 32.

Figure 3B:
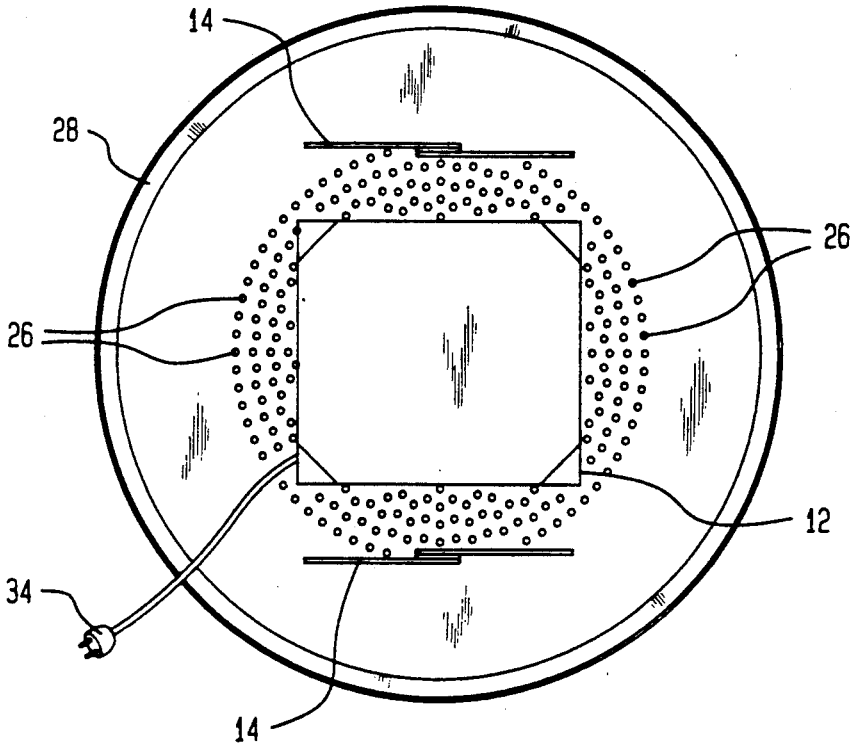
FIG. 3B is a rear plan view of the invention showing the mounting clips inserted into the mounting plates.

Smoke detector 12 attached to the cover 22 is illustrated in FIG. 3B. Mounting clips 14 are attached on opposite sides of the cover 22. A female 36 and male plug 34 connects the smoke detector 12 to the wiring system.

Figure 4:
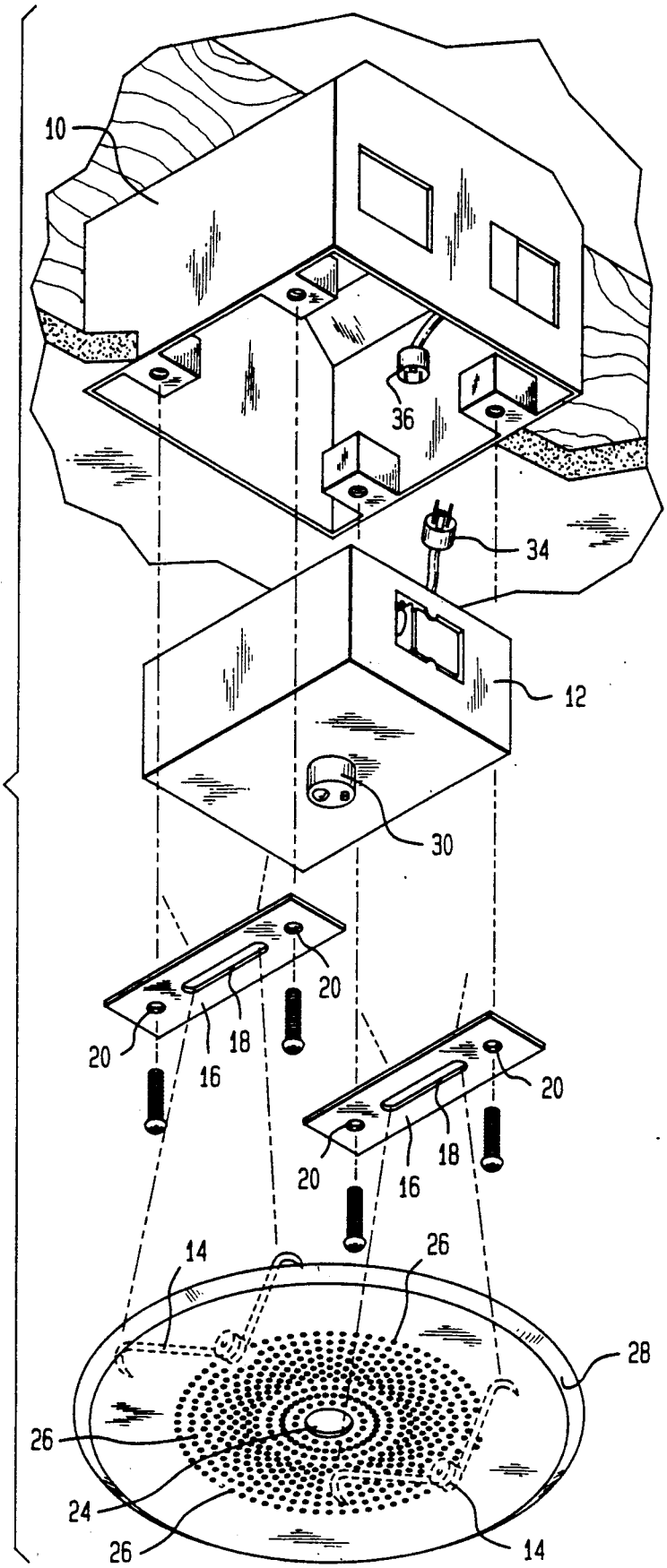
FIG. 4 is an exploded perspective view of the invention.

The housing 10 onto which the mounting plate 16 is attached is illustrated in the exploded view of FIG. 4. A pair of mounting plates 16 are attached to the housing 10 by screws or other attachment means through the apertures 20 located on opposite ends of each plate 16. Each mounting plate 16 includes a rectangular slot 18 for receiving a mounting clip 14. The ends of the mounting clips 14 are squeezed together and inserted into the rectangular slots 18 of the mounting plates 16. When the ends of the mounting clips 14 are released, the cover 22 with the smoke detector 12 attached is connected to the housing 10. The smoke detector 12 is shown detached from the cover 22 in FIG. 4 for illustration only. Normally, the smoke detector 12 is attached to the cover 22. The mounting clips 14 have hooked ends to prevent the cover 22 from separating from the housing 10 after the mounting clips 14 are inserted into the mounting plates 16.

The cover 22 with the smoke detector 12 attached is easy to install by inserting the mounting clips 14 into the mounting plates 16 as described. Smoke detector 12 is held within the housing 10 by cover 22. When the cover 22 is connected to the housing 10, the smoke detector 12 is substantially completely hidden from view to protect the detector 12 from vandals and tamperers, and to provide an aesthetically pleasing appearance. With the increased need for the installation of smoke detectors in homes and other building structures, the present invention provides easy installation, in addition to the other advantages mentioned herein.

While the invention has been described with reference to the preferred embodiment thereof, it will be appreciated by those of ordinary skill in the art that modifications can be made to the structure and elements of the invention without departing from the spirit and scope of the invention as a whole.

I claim:

1. An apparatus for installing a smoke detector substantially flush within a ceiling comprising:

a housing, said housing is a junction box attached within said ceiling, said smoke detector being received in said junction box, a cover including a plurality apertures therein for allowing smoke to reach said smoke detector;

at least two plates, each of which includes a slot therein;

screw means for attaching said two plates to said housing; and at least two spring-bias, V-shaped clips attached to said cover, said two clips each including two free ends, wherein the free ends of said clips can be squeezed together and inserted respectively into said slots of said plates after which said clips tend to move in a direction to return to their original shape and wherein said cover is substantially flush with said ceiling and said smoke detector is substantially completely concealed from view when said smoke detector is installed within said ceiling.

2. The apparatus of claim 1 wherein said junction box comprises a two-gang junction box.

3. The apparatus of claim 1 wherein said housing comprises:

a bottom wall;

side walls; and, a frontal opening, wherein said smoke detector is inserted into said frontal opening and is substantially fully recessed within said housing.

4. The apparatus of claim 3 wherein said cover comprises a loudspeaker-like grille.

* * * * *